US006273646B1

(12) United States Patent
Shaw

(10) Patent No.: US 6,273,646 B1
(45) Date of Patent: Aug. 14, 2001

(54) METHOD OF PRE-STRESSING A TENDON

(75) Inventor: Francis David Shaw, Sandton (ZA)

(73) Assignee: Grinaker- LTA Limited (ZA)

( * ) Notice: Subject to any disclaimer, the term of this patent is extended or adjusted under 35 U.S.C. 154(b) by 0 days.

(21) Appl. No.: 09/269,388

(22) PCT Filed: Sep. 26, 1997

(86) PCT No.: PCT/US97/17392

§ 371 Date: Mar. 26, 1999

§ 102(e) Date: Mar. 26, 1999

(87) PCT Pub. No.: WO98/13580

PCT Pub. Date: Apr. 2, 1998

(30) Foreign Application Priority Data

Sep. 27, 1996 (ZA) ..... 96/8171

(51) Int. Cl.[7] ..... E21D 20/00

(52) U.S. Cl. ..... 405/259.1; 52/704; 411/354; 411/267; 411/268; 411/270

(58) Field of Search ..... 405/258, 259.1, 405/288, 302.2; 52/698, 704; 411/354, 355, 265, 267, 268, 270

(56) References Cited

U.S. PATENT DOCUMENTS

| | | | | |
|---|---|---|---|---|
| 5,085,026 | * | 2/1992 | McGill et al. | 52/698 X |
| 5,397,202 | * | 3/1995 | Shrader et al. | 405/259.6 |
| 5,486,079 | * | 1/1996 | Martin et al. | 411/354 X |
| 5,511,909 | | 4/1996 | Calandra, Jr. | 405/259.6 |
| 5,525,013 | | 6/1996 | Seegmiller | 405/259.3 |
| 5,556,233 | | 9/1996 | Kovago | 405/259.4 |
| 5,586,839 | * | 12/1996 | Gillespie | 405/259.1 |
| 5,785,463 | * | 7/1998 | Eaton et al. | 405/302.2 |
| 5,802,788 | * | 9/1998 | Ozawa et al. | 52/704 X |

* cited by examiner

*Primary Examiner*—Christopher J. Novosad
(74) *Attorney, Agent, or Firm*—Ladas and Parry

(57) ABSTRACT

A tendon 10 is installed in a hole 34 in a mine hanging wall 36 by making use of a barrel 14 and a wedge arrangement 16. One end of the tendon is anchored in the hole 34 such that the other end protrudes therefrom. The barrel 14 is positioned over the protruding end of the tendon 10. A tensioning jack applies a tensile load to the tendon 10 and an oppositely disposed load to a shear ring 20 of the barrel. When the desired preload is reached the shear ring 20 fails permitting the tensioning jack 40 to displace wedge elements 30 of the wedge arrangement 16 inwardly thereby locking the barrel on the tendon and maintaining the desired preload in the tendon.

26 Claims, 4 Drawing Sheets

METHOD OF PRE-STRESSING A TENDON

FIELD OF THE INVENTION

THIS INVENTION relates to the tensioning of tendons. More particularly it relates to a method of pre-stressing a tendon. It also relates to a barrel, to a pre-stressing kit and to a setting tool suitable for use in the method.

SUMMARY OF THE INVENTION

The Inventor is aware that pre-stressed or pretensioned tendons, e.g. lengths of wire rope or steel rods, are often used in the construction and mining industries. For example, in the mining industry, tendons, e.g. in the form of lengths of wire rope, are often used for support, e.g. for the hanging wall, in an underground mine. This can be achieved by drilling a hole in the hanging wall and anchoring an end of the tendon in the hole, e.g. adhesively or mechanically. A bearing element, e.g. an apertured plate, is positioned over the end portion of the tendon protruding from the hole in the hanging wall. The tendon may be tensioned using a barrel and wedge system. This entails positioning a barrel having a hole therethrough over the end portion of the tendon in abutment with the bearing element. The tendon is tensioned to a predetermined level and the barrel is secured to the tensioned tendon by a wedge arrangement positioned between the barrel and the tendon. Hence, the tension in the tendon urges the barrel against the bearing element which in turn is urged into abutment with the hanging wall to support the hanging wall.

In order to install the barrel, use is made of a tensioning jack. The tensioning jack includes a nose which abuts the barrel, a gripping formation which grips the protruding end of the tendon and displacement means for displacing the gripping formation and nose in opposite directions to tension the tendon.

One problem associated with this system is that difficulty can be encountered in setting or blocking of the wedge, i.e. in urging the wedge between the barrel and the tensioned tendon. In addition, once installed there is no indication that the tendon has been correctly tensioned.

It is an object of this invention to provide means which the Inventor believes will at least alleviate this problem.

According to one aspect of the invention there is provided a method of pre-stressing a tendon using a barrel and wedge system which includes the steps of

- positioning a barrel having a hole therethrough over the tendon;
- applying a tensile load to the tendon; and
- applying via a setting member an oppositely disposed force to a spacing member which is configured to transmit said oppositely disposed force to the barrel until a predetermined force is achieved at which stage the setting member urges the wedge arrangement between the barrel and the tendon to secure the barrel in position on the tendon.

The method may include the step of positioning at least part of the wedge arrangement in the hole such that it is a loose fit between the barrel and the tendon prior to applying a load to the tendon, the spacing member being configured to maintain a clearance between the setting member and the wedge arrangement until the predetermined force is achieved at which stage the spacing member permits the setting member to engage the wedge arrangement and urge it between the barrel and the tendon.

The spacing member may fail structurally at the predetermined load which results in the tendon being tensioned to the desired tension. Preferably the structural failure of the spacing member at the predetermined load will be sudden or catastrophic thereby allowing the degree of pretensioning to be controlled fairly accurately.

The spacing member may fail in shear.

According to another aspect of the invention there is provided a barrel for use in pre-stressing a tendon, which includes

- a body having a hole therethrough; and
- a spacing member connected to the body and configured to transmit a load from a setting member to the body.

The spacing member may be configured to fail structurally when a load in excess of a predetermined load is applied thereto.

The body may be generally circular cylindrical in shape, the hole extending axially therethrough and having a diameter which decreases over at least part of its length towards a leading end of the body. The leading end of the body may be rounded.

The spacing member may be annular in form.

The spacing member may be in the form of a shear ring.

An annular recess may be provided in the body immediately adjacent the shear ring into which recess at least part of the material of the shear ring is displaced, in use, when the shear ring fails.

The barrel may include indicating means to indicate that the spacing member has failed and hence that a tendon has been tensioned or pre-stressed to the required tension. The indicating means may include a filler material in the recess which filler material is at least partially displaced when the shear ring fails. The filler material may be configured at least partially to absorb shock loads when the shear ring shears. In one embodiment of the invention, the filler material may be an epoxy. In another embodiment of the invention, the filler material is a metal such as a aluminum. In yet another embodiment of the invention, the filler material is a synthetic plastics material.

The shear ring may be formed integrally with the body. In a preferred embodiment of the invention, the shear ring may be defined between a pair of axially spaced apart annular recesses in the body.

According to yet another aspect of the invention there is provided a pre-stressing kit which includes

- a barrel as hereinbefore described; and
- a wedge arrangement, at least part of which is receivable, in use, in the hole in the body between the body of the barrel and a tendon extending therethrough.

According to still yet another aspect of the invention there is provided a pre-stressing kit which includes

- a barrel having a body through which a hole extends;
- a wedge arrangement, at least,part of which is receivable, in use, in the hole in the body of the barrel between the body and a tendon extending therethrough; and
- a spacing member which is configured, in use, to transmit a force from a setting member to the body of the barrel until a predetermined force is reached at which stage the spacing member permits the setting member to urge the wedge arrangement between the body of the barrel and the tendon to secure the barrel in position on the tendon.

The spacing member may be formed integrally with the body.

The wedge arrangement may include a plurality of wedge elements.

According to a further aspect of the invention there is provided a setting device for use in pre-stressing a tendon using a barrel and wedge system, the barrel of which includes a body and a spacing member in the form of a shear ring fast with the body, the setting device including a nose having a leading end and defining an annular radially inwardly open channel-shaped formation adjacent the leading end; and a shear ring engaging member which is floatingly mounted and held captive in the channel-shaped formation and which is configured to engage and transmit a load to the shear ring of a barrel.

The shear ring engaging member may be in the form of a discontinuous ring.

The nose and the discontinuous ring may include complementary formations configured to cause the discontinuous ring to contract diametrically when the discontinuous ring and nose are urged towards one another in use.

The setting device may be in the form of a tensioning jack and includes a gripping formation for gripping a tendon and displacement means for displacing the gripping formation and the nose in opposite directions.

The invention will now be described, by way of example, with reference to the accompanying diagrammatic drawings.

DETAILED DESCRIPTION OF THE INVENTION

Figure 1:
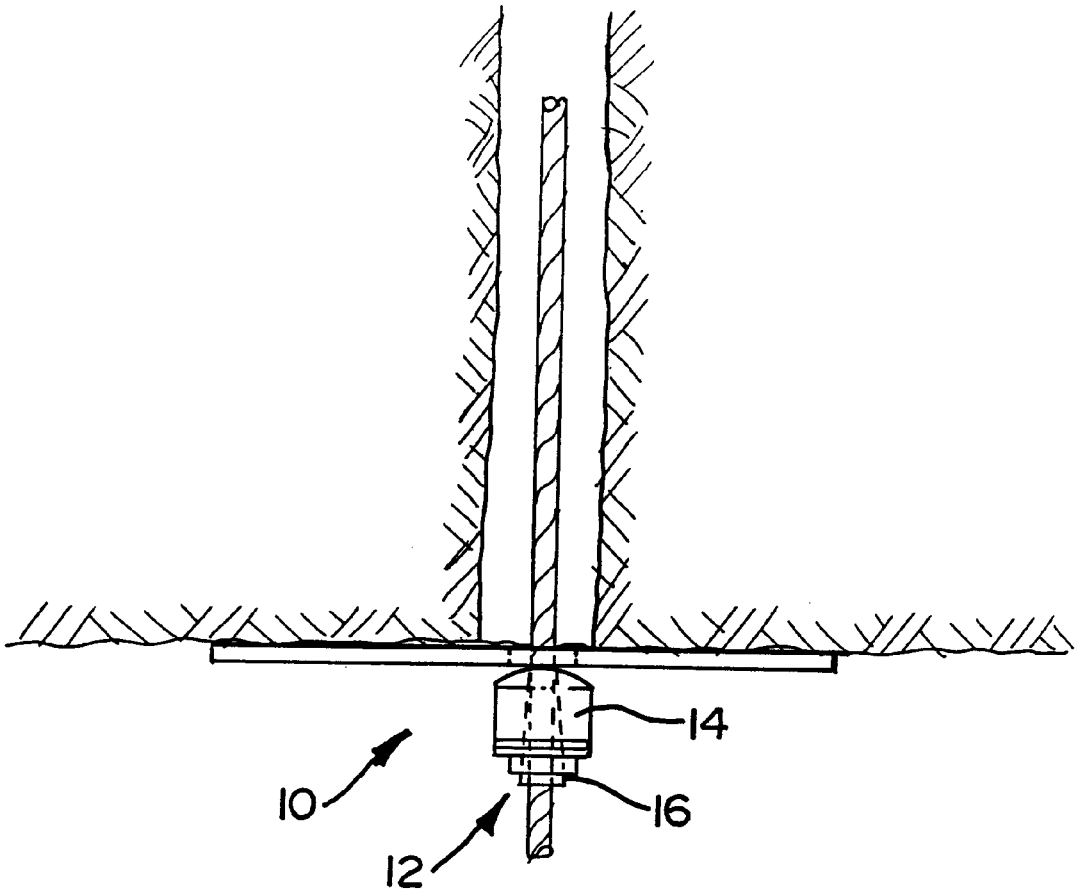
FIG. 1 shows a tendon installed in the hanging wall of a mine in accordance with the invention.

In the drawings, reference numeral 10 refers generally to a pretensioned tendon installed in accordance with the invention.

In order to install the tendon 10, use is made of a pretensioning kit, generally indicated by reference numeral 12. The pretensioning kit 12 includes a barrel 14 and a wedge arrangement 16.

Figure 5:
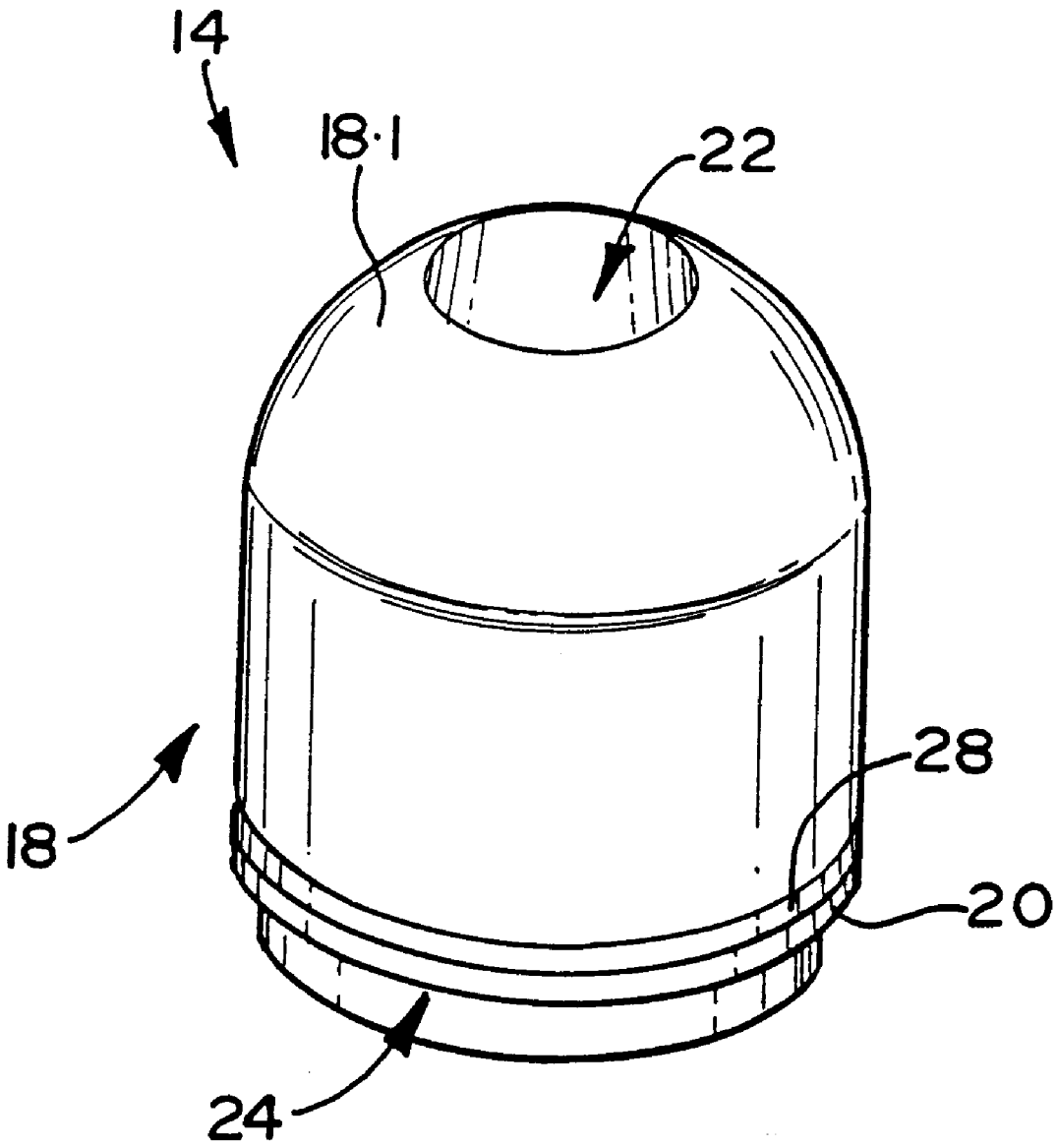
FIG. 5 shows a three-dimensional view of a barrel used in the tendon installation of FIGS. 1 to 3.

As can best be seen in FIG. 5 of the drawings, the barrel 14 includes a body 18. A spacing member, generally indicated by reference numeral 20 is connected to the body 18.

The body 18 is generally circular cylindrical in shape and has a part spherical leading end 18.1. A hole 22 extends axially through the body 18, the diameter of the hole 22 decreasing towards the leading end 18.1.

The spacing member 20 is in the form of a shear ring which is defined between a pair of annular recesses 24, 26. Hence, the shear ring 20 is formed integrally with the body 18. A filler material 28 is contained in the recess 26. The filler material 28 will typically be of a relatively soft material such as an epoxy, a synthetic plastics material, aluminum or the like.

The wedge arrangement 16 includes three wedge elements 30 at least parts of which are receivable in the hole 22 between the radially inner surface of the body 18 and a radially outer surface of the tendon 10. The radially inner surfaces of the wedge elements 30 are provided with teeth-like gripping formations 32 configured to grip the outer surface of the tendon 10 as described in more detail herebelow.

In use, in order to install the tendon 10, a hole 34 is drilled in a hanging wall 36 in a mine. One end of the tendon 10 (not shown) is anchored in the hole 34 e.g. adhesively or mechanically in a conventional fashion such that the tendon 10 protrudes from the hole.

A bearing element in the form of an apertured plate 38 is positioned over the protruding end of the tendon 10. A barrel 14 is then positioned over the protruding end of the tendon such that the rounded leading end 18.1 thereof is in abutment with the plate 38. The wedge elements 30 of the wedge arrangement 16 are then positioned between the radially inner surface of the body 18 and the tendon 10 such that they are a loose fit therein.

Figure 2:
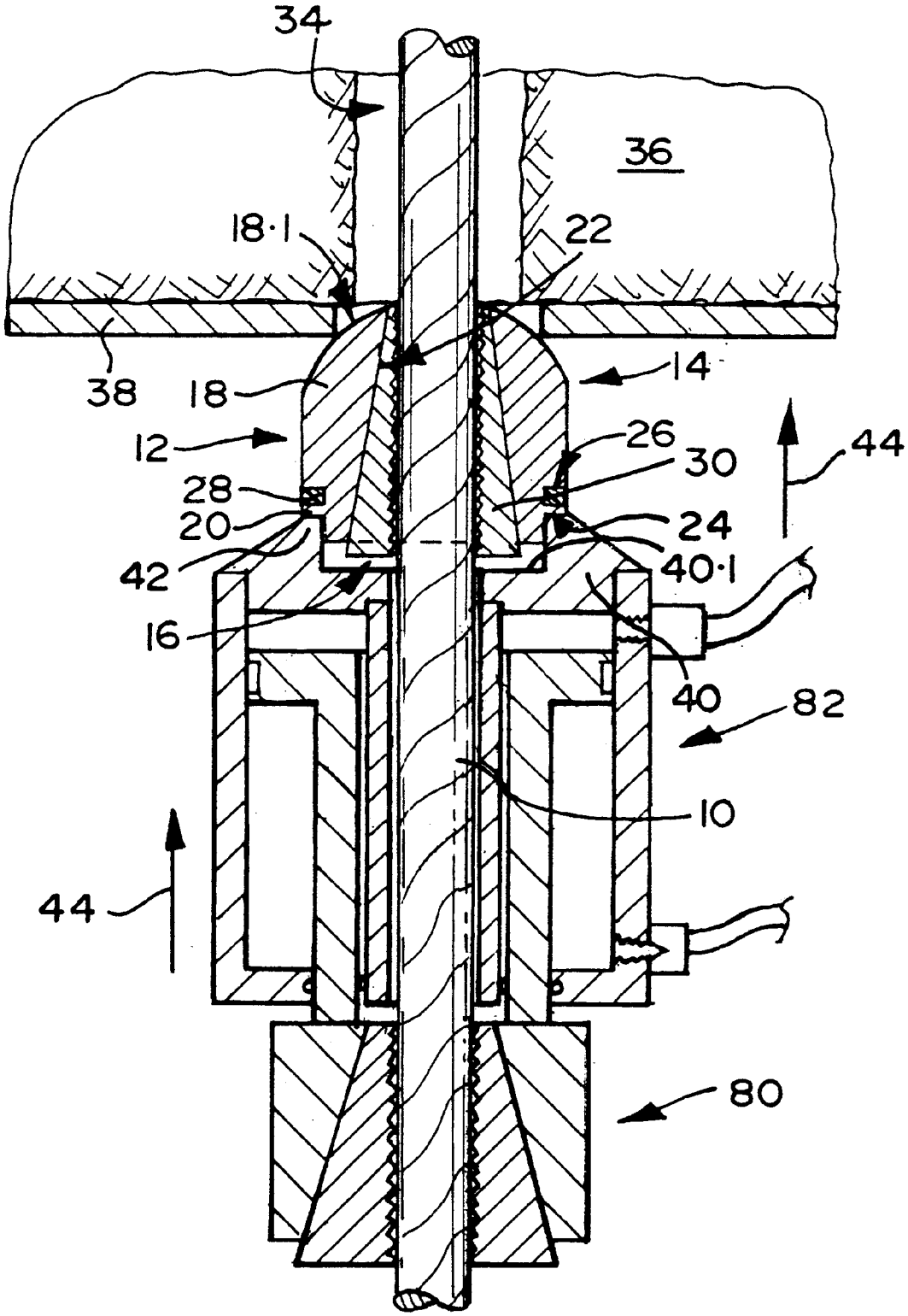
FIGS. 2 and 3 show, on an enlarged scale, sequential steps involved in the installation of the tendon of FIG. 1.
Figure 3:
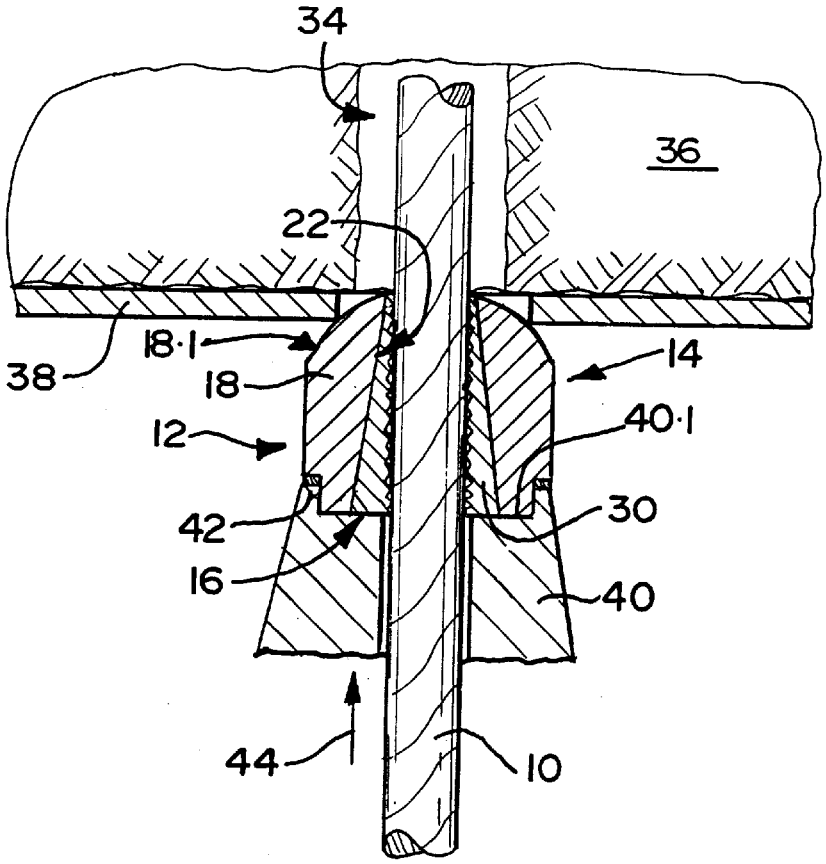

Use is then made of a tensioning jack to tension the tendon 10. The tensioning jack includes a nose 40 (part of which is shown in FIGS. 2 and 3 of the drawings) which is configured to engage the barrel 14 as described in more detail herebelow. The tensioning jack further includes a gripping formation 80 for gripping the protruding end of the tendon 10 and displacement means 82 for displacing the nose 40 and the gripping formation in opposite directions.

As can best be seen in FIG. 2 of the drawings, the nose 40 has a leading end 40.1 from which an annular shoulder 42 protrudes axially. The shoulder 42 has an inner diameter which is slightly larger than the diameter of the trailing end of the body 1 8 such that the shoulder 42 is receivable in the recess 24 in abutment with the shear ring 20. The length of the shoulder 42 is selected such that when the shoulder 42 is in abutment with the shear ring 20, the leading end 40.1 of the nose 40 is spaced from the trailing end of the body 18. Hence, the wedge arrangement 16 is held captive and with clearance between the barrel 14, tendon 10 and leading end 40.1 of the nose 40.

The displacement means 82 is then operated to displace the tendon gripping formation 80 and the nose 40 in opposite directions so that a tensile load is applied to the tendon and an equal and oppositely disposed force is applied to the shear ring 20 and hence to the body 18. When the load reaches a predetermined level, the shear ring 20 shears permitting displacement of the nose 40 in the direction of arrow 44 so that the leading end 40.1 of the nose 40 abuts the wedge arrangement 16 and drives it between the barrel 14 and the tendon 10 as shown in FIG. 3 of the drawings. As the wedge arrangement 16 is driven in the direction of arrow 44 relative to the barrel 14, the complementary taper on the radially inner surface of the body 18 and on the wedge elements 30 causes the wedge elements to move radially inwardly and grip the tendon 10. Hence, contraction of the tendon 10 is resisted and the tensile preload is maintained.

It is to be appreciated, that the shear ring 20 will fail rapidly and that the material of the shear ring will be displaced into the recess 26 thereby displacing at least some of the filler material 28. This then serves as an indication that the tendon 10 has been correctly installed and pretensioned.

Once the tendon 10 has been installed the tensioning jack is removed and any excess tendon is severed.

The tension in the tendon 10 urges the barrel 14 into abutment with the plate 38 which in turn is urged against the hanging wall 36 to provide support thereto.

By varying the load at which the shear ring 20 fails, e.g. by varying its thickness and/or the material of the barrel, the amount of preload applied to the tendon 10 can be varied. In this regard the Inventor has found that by making use of a barrel formed of steel such as EN9 and having a shear ring which is 2,5 mm thick a preload of about 15 KN can be obtained. The filler material may be of a particular colour to indicate the pre-load which can be achieved by making use of a particular barrel 14.

Figure 4:
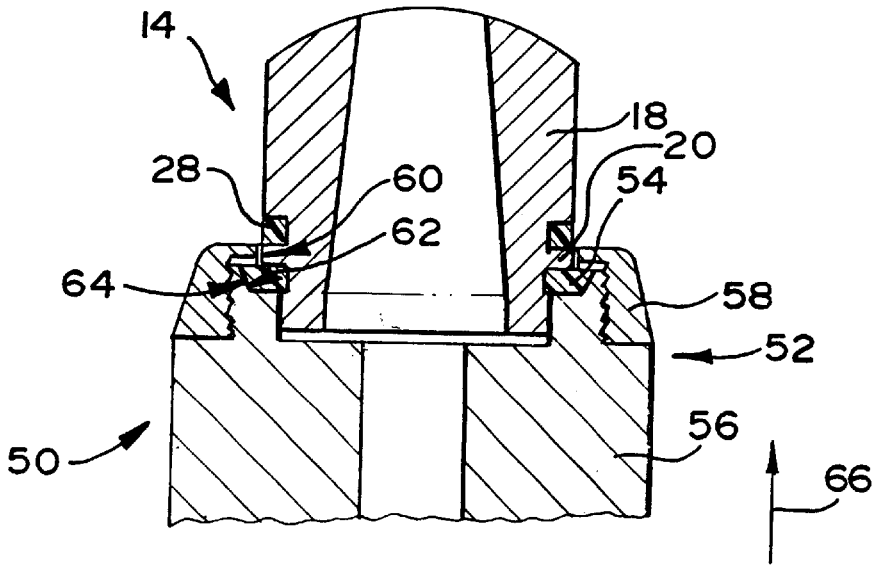
FIG. 4 shows an axial sectional view of part of a setting device in accordance with the invention.

Reference is now made to FIG. 4 of the drawings, in which reference numeral 50 refers generally to part of a setting device in accordance with the invention and unless otherwise indicated, the same reference numerals used above are used to designate similar parts. The setting device 50 will typically be in the form of a tensioning jack and includes a nose 52 and a shear ring engaging member 54.

The nose 52 includes a body 56 and a collar 58 screw-threadedly mounted on the body 56. The body 56 and collar 58 define between them a radially inwardly open generally channel-shaped formation 60 within which the shear ring engaging member 54 is held captive.

The shear ring engaging member 54 is in the form of a discontinuous ring which, in its relaxed state, has an internal diameter which is larger than the diameter of the trailing end of the body 18 and smaller than the diameter of the shear ring 20. The body 56 and the ring 54 are provided with complementary surfaces 62, 64, respectively, which are configured such that when the shear ring engaging member 54 is urged towards the body 56 they cooperate to cause the shear ring engaging member 54 to contract diametrically.

The setting device 50 is used in substantially the identical fashion to that described above in order to pretension a tendon 10.

Hence, when use is made of the setting device 50, the shear ring engaging member 54 will be in its relaxed state in which its diameter is larger than the diameter of the trailing end of the body 18. The setting device 50 is positioned such that the ring 54 abuts against the shear ring 20. As the nose 52 is displaced in the direction of arrow 66 the ring 54 is urged towards the body 56 which causes it to contract diametrically until its inner diameter is only slightly larger than the outer diameter of the trailing end of the body 18. Once the predetermined load is reached, the shear ring 20 shears and the wedge arrangement 16 is blocked or set in the manner described above. When the body 56 is displaced in a direction opposite to the direction of arrow 66 the load applied by the body 56 on the ring 54 is reduced permitting the ring to return to its relaxed state in which its diameter increases thereby facilitating its removal from the barrel 14.

The Inventor believes that this arrangement will facilitate the removal of the setting device 50. In addition, if foreign matter becomes lodged in the channel-shaped formation 60, the collar 58 can be removed so as to facilitate the removal of foreign matter. The inventor believes that using a barrel in accordance with the invention will facilitate the pre-stressing or pretensioning of a tendon and that the desired pretension will be readily obtained.

What is claimed is:

1. A barrel for use in pre-stressing a tendon, which includes a body having a leading end and a hole therethrough; and a spacing member in the form of a shear ring fast with the body and configured to transmit a compressive load applied by a setting member to the body, the spacing member being designed to yield in the direction of the leading end of the body when a predetermined compressive load is applied thereto.

2. A barrel as claimed in claim 1, in which the body is generally circular cylindrical in shape, the hole extending axially therethrough and having a diameter which decreases over at least part of its length towards a leading end of the body, the leading end of the body being rounded, an annular recess is provided in the body immediately adjacent the shear ring into which recess at least part of the material of the shear ring is displaced, in use, when the shear ring fails, the barrel including indicating means to indicate that the spacing member has failed and hence that a tendon, has been tensioned to the required tension, the indicating means including a filler material in the annular recess which filler material is at least partially displaced when the shear ring fails and the filler material being configured at least partially to absorb shock loads when the shear ring shears.

3. A barrel as claimed in claim 1, in which the shear ring is formed integrally with the body.

4. A barrel as claimed in claim 1, in which the shear ring is defined between a pair of axially spaced apart annular recesses in the body.

5. A pre-stressing kit which includes a barrel as claimed in claim 1, inclusive; and a wedge arrangement, at least part of which is receivable, in use, in the hole in the body between the body of the barrel and a tendon extending therethrough.

6. A pre-stressing kit which includes a barrel having a body through which a hole extends; a wedge arrangement, at least part of which is receivable, in use, in the hole in the body of the barrel between the body and a tendon extending therethrough; and a spacing member formed integrally with the body through which, in use, a compressive load applied by a setting member to the body of the barrel is transmitted until a predetermined load is reached at which stage the spacing member permits the setting member to apply a load to the wedge arrangement to set the wedge arrangement between the body of the barrel and the tendon to secure the barrel in position on the tendon.

7. A pre-stressing kit as claimed in claim 6, in which the wedge arrangement includes a plurality of wedge elements.

8. A setting device for use in pre-stressing a tendon using a barrel and wedge system, the barrel of which includes a body and a spacing member in the form of a shear ring fast with the body, the setting device including a nose having a leading end and defining an annular radially inwardly open channel-shaped formation adjacent the leading end; and a shear ring engaging member which is in the form of a discontinuous ring held captive in the channel-shaped formation and which is configured to engage and transmit a load to the shear ring of the barrel.

9. A setting device as claimed in claim 8, in which the nose and the discontinuous ring include complementary formations configured to cause the discontinuous ring to contract diametrically when the discontinuous ring and nose are urged towards one another in use.

10. A setting device as claimed in claim 8, which is in the form of a tensioning jack and includes a gripping formation for gripping a tendon and displacement means for displacing the gripping formation and the nose in opposite directions.

11. A barrel for use in pre-stressing a tendon which includes a body having a leading end and a hole therethrough through which a part of a tendon to be tensioned can pass; and a zone of weakness which is configured to yield in the direction of the leading end of the body when the body is subjected to a predetermined compressive load.

12. A barrel for use in pre-stressing a tendon which includes a unitary body formed from a single piece of steel, the body having a leading end and a hole therethrough through which a part of a tendon to be tensioned can pass, part of the body being connected to the remainder of the body by a zone of weakness configured to yield in the direction of the leading end when the body is subjected to a predetermined compressive load so that said part of the body is displaced relative to the remainder of the body when the body is subjected to said predetermined compressive load.

13. A barrel is claimed in claim 12, in which the two parts of the body are interconnected by a zone of weakness which is designed to yield when the body is subjected to said predetermined load.

14. A barrel as claimed in claim 13, in which the body is generally circular cylindrical in shape, the hole extending axially therethrough and having a diameter which decreases over at least part of its length towards a leading end of the body which is rounded, the one part of the body being in the form of an annular shear ring, the zone of weakness being provided by a circumferential shear area at an inner diameter of the shear ring.

15. A barrel as claimed in claim 12, which includes indicating means to indicate when a said predetermined compressive load has been applied to the body, the indicating means including an annular recess in the body, the width of which decreases when the predetermined compressive load is applied to the body.

16. In the pre-stressing of a tendon anchored at one end, by making use of a tensioning jack having a nose bearing against a tapered barrel around the other end of the tendon, there is provided a method which includes steps of providing a spacing member through which a load applied by the nose to the barrel is transmitted, the spacing member being designed to yield at a predetermined load between the nose and the barrel; and using such yield to cause the nose to set a wedge arrangement in the barrel to grip the tendon.

17. A method according to claim 16, in which the spacing member is designed to yield in the direction of the load to a predetermined extent.

18. A method according to claim 16, in which there is provided an initial axial clearance space between the nose and the wedge arrangement, the clearance space being arranged to be less than the extent to which the spacing member is designed to yield.

19. A method as claimed in claim 16, in which the spacing member is integral with the barrel via a zone of weakness.

20. A method as claimed in claim 19, in which the spacing member is shaped and dimensioned to cooperate with the nose of the jack and includes an annular ring spaced from the rest of the barrel by an annular groove and in which a zone of weakness is provided by a circumferential shear area at the inner diameter of the annular ring; the axial length of the groove determining the extent to which the spacing member is designed to yield.

21. A barrel for use in pre-stressing a tendon which includes a unitary body which is generally circular cylindrical in shape and has a hole extending axially therethrough through which part of a tendon to be tensioned can pass, the hole having a diameter which decreases over at least part of its length towards a leading end of the body, the leading end of the body being rounded; and a zone of weakness which is configured to yield in the direction of the leading end of the body when the body is subjected to a predetermined compressive load.

22. A barrel as claimed in claim 21, which includes an annular groove in the body, the width of which decreases as the zone of weakness yields.

23. A barrel as claimed in claim 22, which includes an annular shear ring integral with the body adjacent to the annular groove, the zone of weakness being provided by a circumferential shear area at the inner diameter of the shear ring.

24. A barrel for use in pre-stressing a tendon which includes a unitary body which is generally circular in shape and has a hole extending axially therethrough through which a part of a tendon to be tensioned can pass, the hole having a diameter which decreases over at least part of its length towards a leading end of the body, the leading end of the body being rounded; and indicating means integral with the body to indicate when a predetermined compressive load has been applied to the body.

25. A barrel as claimed in claim 24, in which the indicating means includes an annular recess in the body, the width of which decreases when the predetermined compressive load is applied to the body.

26. A barrel for use in pre-stressing a tendon which includes a body having a hole therethrough through which a part of a tendon to be tensioned can pass; and an annular recess in an outer surface of the body, the width of which decreases when the body is subjected to a predetermined compressive load.

* * * * *